United States Patent [19]

Borowitz

[11] 4,295,584

[45] Oct. 20, 1981

[54] SIDE DISPENSING CLOSURE

[76] Inventor: Raymond P. Borowitz, Rte. 6, Box 2067, Escondido, Calif. 92026

[21] Appl. No.: 5,340

[22] Filed: Jan. 22, 1979

[51] Int. Cl.[3] ..... B65D 47/28

[52] U.S. Cl. ..... 222/519; 215/223; 215/340

[58] Field of Search ..... 222/499, 519, 522, 549, 222/553, 524; 215/223, 340

[56] References Cited

U.S. PATENT DOCUMENTS

| | | | |
|---|---|---|---|
| 2,112,125 | 3/1938 | Bultzingslowen | 222/553 X |
| 2,348,014 | 5/1944 | Mallard | 222/519 X |
| 2,463,152 | 3/1949 | Clark | 222/522 X |
| 3,067,916 | 12/1962 | Lerner | 222/519 |
| 3,261,513 | 7/1966 | Moran | 222/553 X |
| 3,305,145 | 2/1967 | Tebbutt | 222/522 |

FOREIGN PATENT DOCUMENTS

| | | | |
|---|---|---|---|
| 1046181 | 12/1953 | France | 222/553 |
| 1179000 | 5/1959 | France | 222/553 |

*Primary Examiner*—Robert J. Spar
*Assistant Examiner*—Edward M. Wacyra

[57] ABSTRACT

A dispensing closure in which the discharge passage is provided in an opening or openings in the side wall of the closure. The dispensing position of the closure is accomplished by it's elevation above the upper end of the container by a twist motion when equipped with threads to unscrew, or by a pull-up slide arrangement designed into the container and closure. It is returned by a reverse procedure to a closed and full sealing position for complete protection of the containers ingredients.

1 Claim, 5 Drawing Figures

SIDE DISPENSING CLOSURE

This invention relates to a new type of dispensing closure that provides a simplified discharge passage from the side of the closure by means of an opening or openings that are constructed or formed in the side wall of the closure and become positioned for dispensing when the closure is elevated above the throat-end of the container. The elevation is accomplished by partial unscrewing when a threaded container throat is used, or by a pullingup procedure when on a slide type of container throat. When the closure is in a sealing position the usual full seal is maintained by the inside top of the closure against the lip edge of the container throat, thereby assuring maximum sealing and safety to the ingredients inside the container.

Various dispensing closures in common use today provide discharge techniques involving a lever or spout afixed into or otherwise attached to the closure, or other various techniques, all designed for the elimination or discharge of the container's ingredients from the top side of the closure. An important object achieved in the present invention is the discharge from the side area of the closure, thereby permitting manufacture of the closure in a simple one-piece design, and yet provide the complete sealing of the container's contents that is normally only found in a non-dispensing closure.

A further important object that the invention achieves is the great variations in dispensing that are possible through such side discharge, in that the opening or openings can be adaptable in size or design modification to accommodate the wide range of characteristics that the ingredients in the container may have, such as a fluid, cream, paste, granular, or of other forms that would control the method and/or degree of discharge desired from the container. Contrasting examples of this would be a highly fluid liquid ingredient which may require a minute opening for control in dispensing, as opposed to large granular ingredients that would be shaken out of a large size opening or openings. Therefore, the accompanying drawing is not to be taken so as to limit this invention in any respect, since many designs are possible utilizing the invention's essential features.

The foregoing advantages of the invention are illustrated by the accompanying drawings and descriptions that further detail its features and operation in which.

Figure 1:
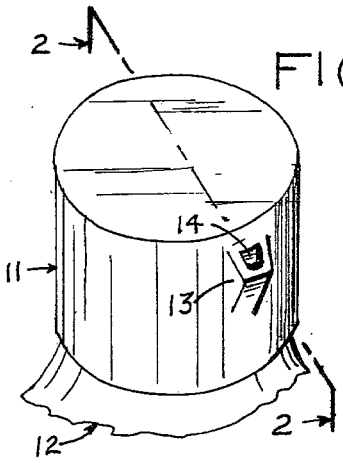
FIG. 1 is a fragmentary perspective view of one form of the closure of the invention mounted on a container.

Referring now to the embodiment of the invention as shown in the drawing provided it shows in FIG. 1 a dispensing closure 11 mounted on a container 12. The closure 11 has an angular dispensing spout 13 from which an opening 14 is used to direct the discharge of ingredients from within the container.

Figure 2:
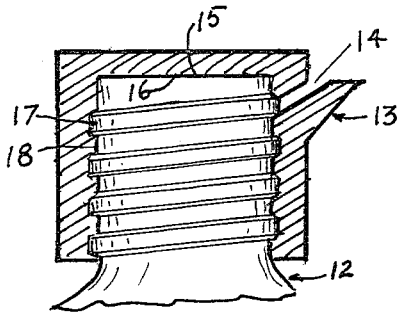
FIG. 2 is a fragmentary sectional view taken of the line 2—2 of FIG. 1 showing the closed or sealing position.
Figure 3:
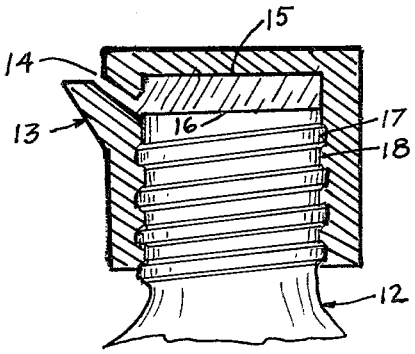
FIG. 3 is a fragmentary sectional view, similar to FIG. 2, but showing the closure in a dispensing position.
Figure 4:
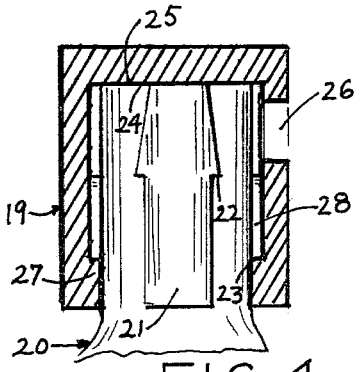
FIG. 4 is a fragmentary sectional view of a second form of closure in a closed position, but with a slide function to operate.
Figure 5:
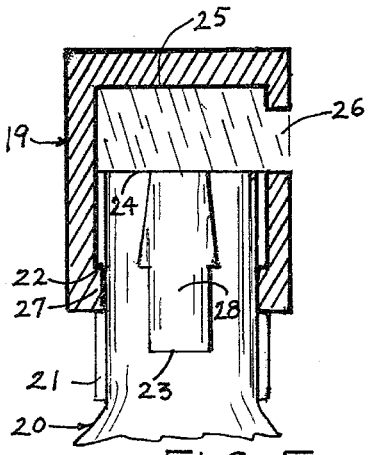
FIG. 5 is a fragmentary sectional view similar to FIG. 4 in an open or dispensing position.

In FIGS. 2 and 3 the closure is shown mounted on the container by means of a threaded neck 17 on the container and internal threads 18 of the closure, but it may also be afixed to the container by means of a slide arrangement as shown in FIGS. 4 and 5.

In FIG. 2 the closure is completely tightened down onto the threads, and a complete seal is made between the inside lid 15 and the lip edge 16 of the container's throat. A secondary inside lid as a form of gasket attached to the inside lid 15 may be used to provide a more secure seal.

When the closure is turned in a normal unthreading procedure the closure becomes elevated upon the container's throat as shown in FIG. 3 in a half turn, and permits the discharge of the ingredients in the container through the opening between the closure lid 15 and the lip edge 16 and out through the opening 14. There are many variations possible in this discharge method, such as the size and shape of the opening depending on the ingredients and the control desired as was previously mentioned. Some ingredients may best be dispensed from a series or multiple openings to obtain dispersment desired, such as for table salt or pepper, and arranged around the perimeter of the side wall of the closure. Adaption can be made also in the degree of angle of the threads to permit a rapid or steep elevation of the closure with a minimum of turning to accommodate a larger size of opening than shown in FIGS. 3 and 4 for such ingredients that could best be handled through a larger size of opening.

The closure is preferably constructed or molded of plastic material, such as polyethylene, but other suitable materials that would lend itself to the adaptability of the closure may also be used. Where the closure is integral to the container an acceptability of manufacturing and/or molding characteristics of the material used would also be considered.

The container holding the ingredients may be constructed of any suitable material generally consistent with the storage and protection of the ingredients. The dispensing of the ingredients may be by gravity flow, shaking or similar means, such as squeezing when the container is of a squeezable plastic construction to provide added force for the dispensing of some ingredients and where a more rapid discharge is otherwise desired.

Another form of dispensing closure is shown in FIGS. 4 and 5, still similar in the side discharge method but constructed to slide upon the container. In FIG. 4 in a closed position, the closure 19 is fitted to the container 20. An arresting arm 27 is positioned against the underside stop 23 of a verticle pillar 28 to secure a snug closure of the cap lid 25 against the lip edge 24 of the container for a complete seal.

To open, the closure is twisted a partial turn until the arresting arm 27 contacts the side of a verticle pillar 21 and is slid up to the verticle pillar stop 22 as shown in FIG. 5. This has positioned the closure 19 above the throat end of the container, and the opening provided between the closure lid 25 and the lip edge 24 permits the discharge of the ingredients in the container through the outlet opening 26. This opening shown has a very simplified design, but as previously mentioned can be adapted with a spout design as shown in FIGS. 1, 2 and 3 or with any other size and shape to accommodate the ingredients discharge from the container. A reverse procedure is used to close by sliding down upon the arresting arm 27 until the closure lid 25 contacts the lip edge 24 and a partial turn is made to permit the snug fit of the arresting arm 27 against the underside stop 23.

Having described my invention I claim:

1. A dispensing closure and container comprising: a closure with a top and side wall portion or skirt; said skirt having an opening or openings of any size constructed or molded therein for the dispensing of container's contents; said skirt also having inward facing projections; a container with an open-end neck portion; said neck having external longitudinally extending pillars cooperating with the inward facing projections of the cap skirt to define a guidepath of axial reciprocation; there being at least two pillars forming the guidepath; each pillar having vertically positioned stop lugs to limit the extent of outward opening axial movement of the cap; and alternate pillars having a length less than an adjacent pillar to receive the inward projections of the cap skirt in the inward closed position of the cap upon partial rotation of the cap to seal the cap in the closed position.

* * * * *